US006543499B2

(12) United States Patent
McCreery

(10) Patent No.: US 6,543,499 B2
(45) Date of Patent: Apr. 8, 2003

(54) INTERCHANGEABLE CARRYING BAG SYSTEM

(76) Inventor: Susan Mary McCreery, 500 N. Davis Rd., Bldg. 1, #24, Palm Springs, FL (US) 33461

( * ) Notice: Subject to any disclaimer, the term of this patent is extended or adjusted under 35 U.S.C. 154(b) by 0 days.

(21) Appl. No.: 09/755,903

(22) Filed: Jan. 5, 2001

(65) Prior Publication Data

US 2001/0015248 A1 Aug. 23, 2001

Related U.S. Application Data

(63) Continuation-in-part of application No. 09/513,227, filed on Feb. 23, 2000, now abandoned.

(51) Int. Cl.[7] ..... A45C 13/08
(52) U.S. Cl. ..... 150/104; 190/110
(58) Field of Search ..... 150/105, 103, 150/104, 107; 190/110, 116; 238/13, 18

(56) References Cited

U.S. PATENT DOCUMENTS

| | | | | |
|---|---|---|---|---|
| 3,536,116 A | | 10/1970 | Margolis | |
| 3,881,534 A | | 5/1975 | Gist | |
| 4,027,710 A | | 6/1977 | Keebler | |
| 4,263,951 A | * | 4/1981 | Siegel | 150/35 |
| 4,754,790 A | | 7/1988 | Meyers | |
| 4,907,633 A | | 3/1990 | Eckstein | |
| D334,661 S | * | 4/1993 | Kohn | D3/39 |
| 5,207,254 A | * | 5/1993 | Fromm | 150/104 |
| 5,503,204 A | | 4/1996 | Byers et al. | |
| 5,533,558 A | | 7/1996 | Carey et al. | |
| D374,346 S | * | 10/1996 | Giovannell | D3/243 |
| 5,649,581 A | | 7/1997 | Kopel | |
| 5,725,039 A | | 3/1998 | Macinai et al. | |
| 6,179,025 B1 | * | 1/2001 | Sutton | 150/105 |
| 6,186,201 B1 | * | 2/2001 | Salz | 150/105 |
| 6,216,297 B1 | * | 4/2001 | Lemke | 5/636 |

FOREIGN PATENT DOCUMENTS

| | | |
|---|---|---|
| FR | 1 059 597 | 3/1954 |
| FR | 2 629 794 | 10/1989 |

* cited by examiner

*Primary Examiner*—Lee Young
*Assistant Examiner*—Lien Ngo

(57) ABSTRACT

An interchangeable carrying bag system and method is provided having an inner bag, an outer bag, a first fastening structure attached to the inner surface of the outer bag and to the outer surface of the inner bag and at least one piece of decorative material reversibly attachable to the outer surface of the inner bag when the inner bag is used independently of the outer bag. In addition, a second fastening structure can be attached to the inner bag.

18 Claims, 5 Drawing Sheets

INTERCHANGEABLE CARRYING BAG SYSTEM

CROSS-REFERENCE TO RELATED APPLICATIONS

This application claims the priority of U.S. non-provisional patent application Ser. No. 09/513,227 filed Feb. 23, 2000

This application is a CIP of application Ser. No. 09/513,227 filled Feb. 23, 2000, now abandoned.

STATEMENT REGARDING FEDERALLY SPONSORED RESEARCH OR DEVELOPMENT (Not applicable)

BACKGROUND

1. Technical Field

The present invention relates generally to carrying bags and more particularly to a system for interchanging carrying bags.

2. Description of Related Art

In today's fashion conscious world, handbags, purses and other similar carrying bags have become indispensable accessories to the wardrobes of a large part of the population. As a result, carrying bag manufacturers continue to introduce new styles to meet the buying public's desire for these items. To take advantage of the versatility offered by such a vast array of designs, several attempts have been made to develop an interchangeable bag system.

U.S. Pat. No. 5,207,254 to Fromm is directed to a convertible handbag which includes an outer bag and an inner lining pouch. The inner lining pouch can be inserted into the outer bag and engaged with the outer bag by a hook and loop type fastener. In addition, if the inner lining pouch is used independently, the top edges of the inner pouch can be folded inward and engaged by the hook and loop type fastener thereby sealing the inner pouch. The inner pouch also contains two lifting straps which enable a user to carry the inner pouch when used independently.

The Fromm patent, however, suffers from several significant disadvantages. Specifically, a user must cram the lifting straps into a gap located between the inner pouch and the outer bag when the inner pouch is fastened to the outer bag. Moreover, when converting the inner pouch to its independent carrying status, the user faces the awkward task of folding the top edges of the inner pouch and mating the hook and loop type fasteners located on these top edges. Furthermore, the user may be reluctant to use the inner lining pouch independently due to the unattractive nature of the lifting straps. Thus, what is needed in the art is an interchangeable carrying bag system that permits users to use a wide variety of different carrying bags yet advantageously streamline the inner bag conversion process without negatively affecting the system's aesthetics.

SUMMARY OF THE INVENTION

The invention features an interchangeable carrying bag system. In one arrangement, the invention can include: an inner bag having an inner surface and an outer surface; an outer bag having an inner surface and an outer surface; first fastening structure attached to the outer surface of the inner bag and the inner surface of the outer bag in which the outer surface of the inner bag is reversibly attachable to the inner surface of the outer bag by the first fastening structure; and at least one piece of decorative material reversibly attachable to the first fastening structure on the outer surface of the inner bag when the inner bag is used independently of the outer bag.

In another arrangement, the invention can also include a second fastening structure attached to the inner bag. The second fastening structure can be a zipper, at least one snap or a hook and loop type fastener.

In another aspect of the invention, the first fastening structure can be a hook and loop type fastener. Alternatively, the first fastening structure can be at least one snap. In another variation of the above invention, the inner bag can contain at least one pouch permanently affixed to the inner bag. Additionally, the inner bag can contain at least one pouch removably attached to the inner bag. In another aspect, a first portion of the first fastening structure is attached to a first portion of the inner surface of the outer bag and a cooperating portion of the first fastening structure is attached to a second portion of the inner surface of the outer bag.

In another variation of the above system, the piece of decorative material can be a strip. Additionally, the piece of decorative material can be a loop. In another arrangement, the outer bag can include a strap permanently affixed to the outer bag. Alternatively, the outer bag can include a strap removably attached to the outer bag.

In another arrangement, the first fastening structure can be attached to the inner surface and the outer surface of the outer bag in which the outer bag is reversible. In addition, the piece of decorative material can be reversibly attachable to the outer surface of the outer bag.

The invention can also feature a method for interchanging carrying bags. In one arrangement, the invention can include the steps of: providing an inner bag having an inner surface and an outer surface; providing an outer bag having an inner surface and an outer surface; providing a first fastening structure attached to the outer surface of the inner bag and the inner surface of the outer bag; reversibly attaching the outer surface of the inner bag to the inner surface of the outer bag; and reversibly attaching at least one piece of decorative material to the first fastening structure on the outer surface of the inner bag when the inner bag is used independently of the outer bag.

In another arrangement, the method can further include the step of providing a second fastening structure in which the second fastening structure is attached to the inner bag. In one aspect of the above method, the second fastening structure can be a zipper. Alternatively, the second fastening structure can be at least one snap. In addition, the second fastening structure can also be a hook and loop type fastener.

In another aspect of the above method, the first fastening structure can be a hook and loop type fastener. Alternatively, the first fastening structure can be at least one snap. In another aspect, a first portion of the first fastening structure can be attached to a first portion of the inner surface of the outer bag and a cooperating portion of the first fastening structure can be attached to a second portion of the inner surface of the outer bag.

In another arrangement of the above method, the inner bag can contain at least one pouch permanently affixed to the inner bag. Alternatively, the inner bag can contain at least one pouch removably attached to the inner bag. In another variation of the above method, the piece of decorative material can be a strip. Additionally, the piece of decorative material can be a loop. In another arrangement, the outer bag can contain a strap permanently affixed to the outer bag.

Alternatively, the outer bag can contain a strap removably attached to the outer bag.

In another variation, the above method can include the step of attaching the first fastening structure to the inner surface and the outer surface of the outer bag. In addition, the above method can include the step of reversing the outer bag. Moreover, the above method can also include the step of reversibly attaching the piece of decorative material to the outer surface of the outer bag.

DETAILED DESCRIPTION

Figure 1:
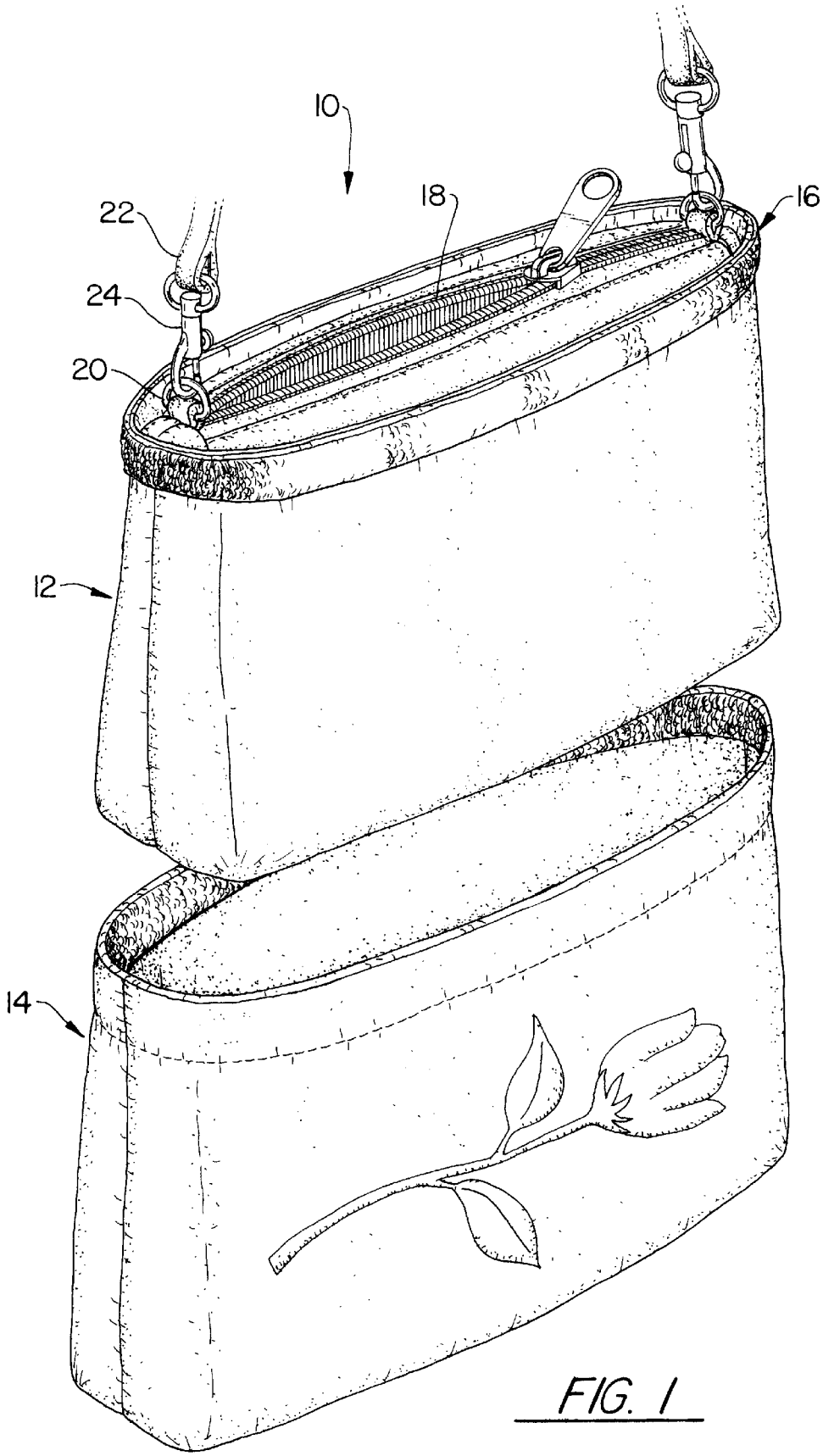
FIG. 1 is a perspective view of an interchangeable carrying bag system showing an inner bag and an outer bag.

Referring to FIG. 1, an interchangeable carrying bag system 10 is shown. The system 10 can include an inner bag 12, an outer bag 14, and first fastening structure 16. The inner bag 12 can be made of a flexible material such as leather or vinyl or a hard material such as plastic or wood. The outer bag 14 can be made of a flexible material such as leather or vinyl; however, the invention is not limited in this regard as the inner bag 12 and outer bag 14 can be constructed of any other suitable material. The first fastening structure 16 can be attached to the outer surface of the inner bag 12 and the inner surface of the outer bag 14. The first fastening structure 16 is preferably a hook and loop type fastener. Alternatively, the first fastening structure 16 can be at least one snap; however, the invention is not limited in this regard as the first fastening structure 16 can be any other suitable fastening structure.

The inner bag 12 can also include a second fastening structure 18 attached to the inner bag 12 for closing the inner bag 12. The second fastening structure 18 can be a zipper, at least one snap or a hook and loop type fastener; however, the invention is not limited in this regard as the second fastening structure 18 can be any other suitable fastening structure.

The inner bag 12 can also include a pair of loops 20 for receiving a first strap 22. The first strap 22 can contain a pair of spring clips 24 for engaging the loops 20. The first strap 22 can be used to facilitate carrying of the inner bag 12 when the inner bag 12 is used independently. The first strap 22 can also be permanently attached to the inner bag 12.

Figure 2:
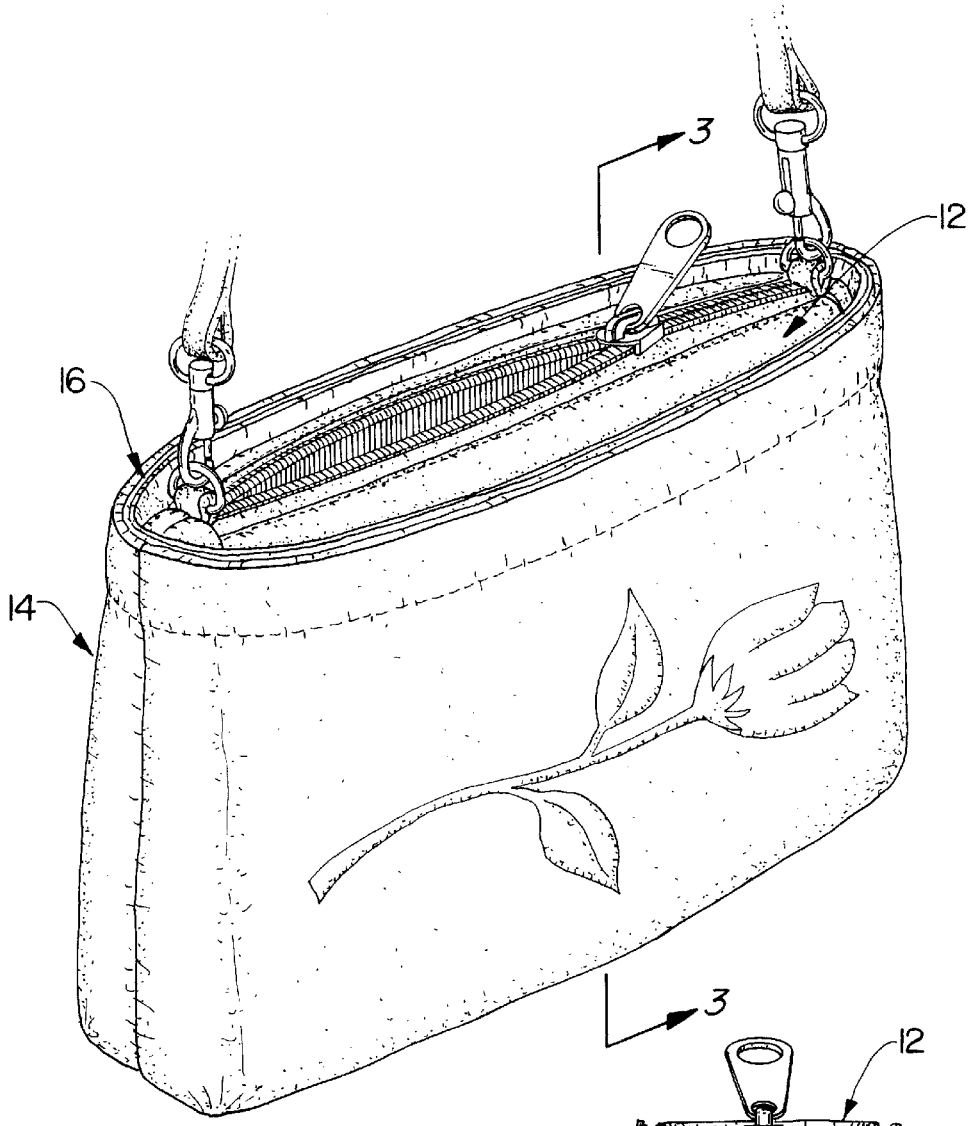
FIG. 2 is a perspective view showing the inner bag and outer bag of FIG. 1 engaged.
Figure 3:
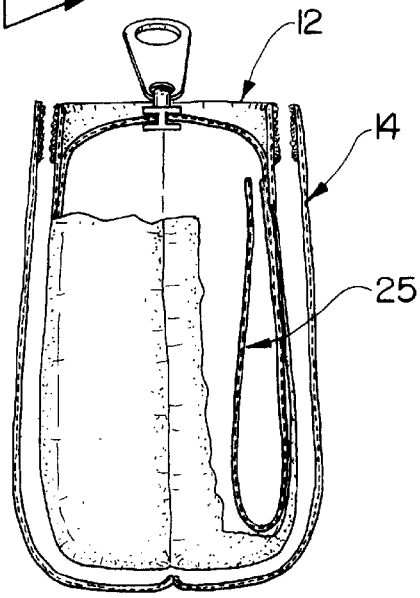
FIG. 3 is a side view of the interchangeable carrying bag system showing the inner bag inserted in the outer bag.

As shown in FIG. 2, the inner bag 12 can be inserted into the outer bag 14. The inner bag 12 can then be reversibly attached to the outer bag 14 by the first fastening structure 16. FIG. 3 shows the inner bag 12 disposed in the outer bag 14. As shown, the inner bag 12 can contain at least one pouch 25. This pouch 25 can be removably attached to the inner bag 12 or, alternatively, can be permanently affixed to the inner bag 12.

Figure 4:
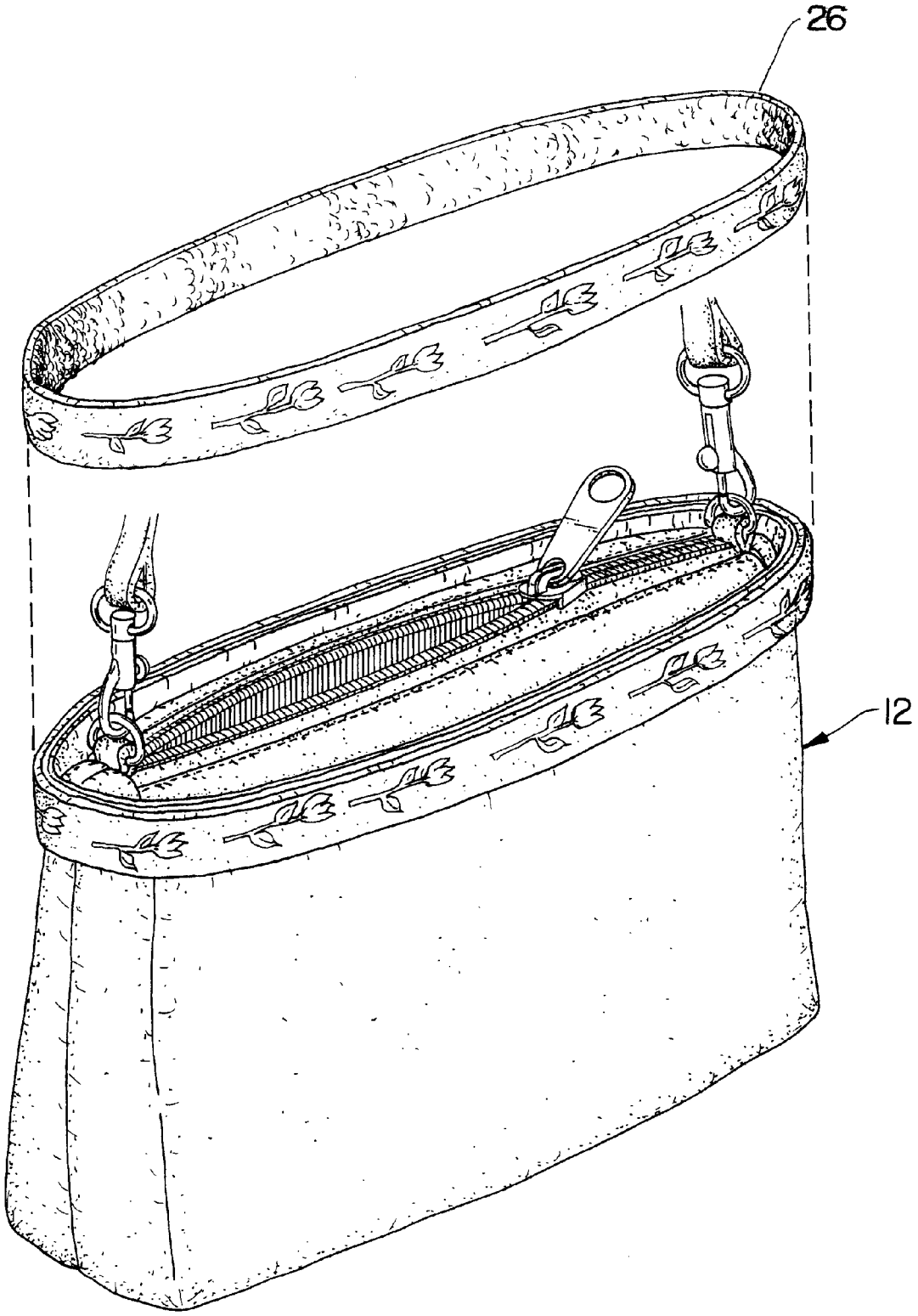
FIG. 4 shows a piece of decorative material encompassing the inner bag of the interchangeable carrying bag system.

Referring to FIG. 4 the inner bag 12 can be carried independently of the outer bag 14. At least one piece of decorative material 26 can be reversibly attached to the fastening structure 16 on the outer surface of the inner bag 12. In addition, the piece of decorative material 26 can be a strip or a loop. Although FIG. 4 shows the piece of decorative material 26 completely encompassing the inner bag 12, the decorative material 26 can be comprised of several pieces in which the length of each piece is less than the circumference of the inner bag 12.

Figure 5:
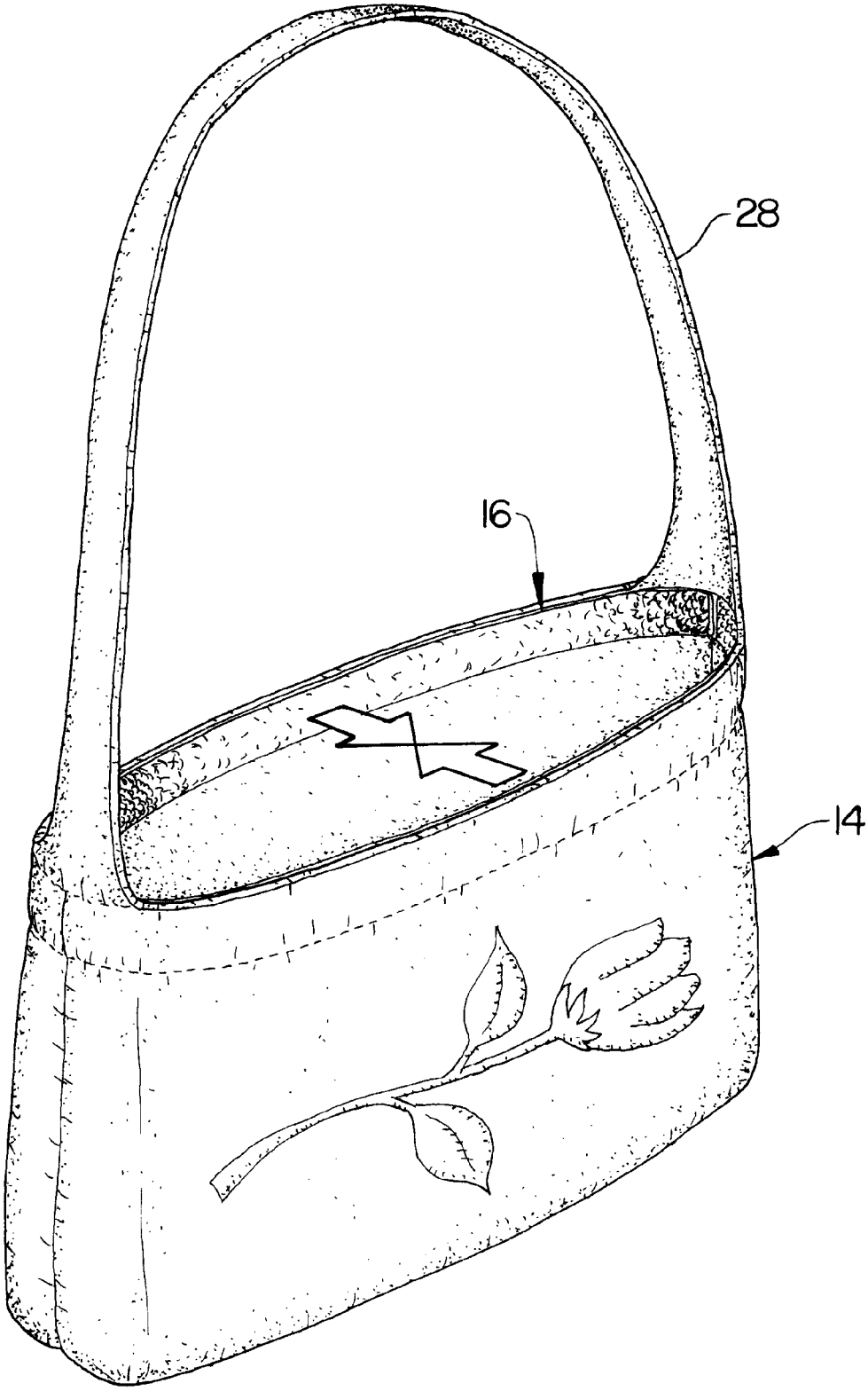
FIG. 5 shows the outer bag of the interchangeable carrying bag system.

FIG. 5 shows an alternative embodiment of the outer bag 14. In this arrangement, the first fastening structure 16 can be attached to inner opposing surfaces of the bag 14. As shown, the first fastening structure 16 can be attached to one of the inner opposing surfaces can be engaged with the first fastening structure 16 can be attached to the other inner opposing surface of the outer bag 14. The outer bag 14 can also contain a second strap 28 permanently affixed to the outer bag 14. Alternatively, the outer bag 14 can be arranged to receive a reversibly attachable strap.

Figure 6:
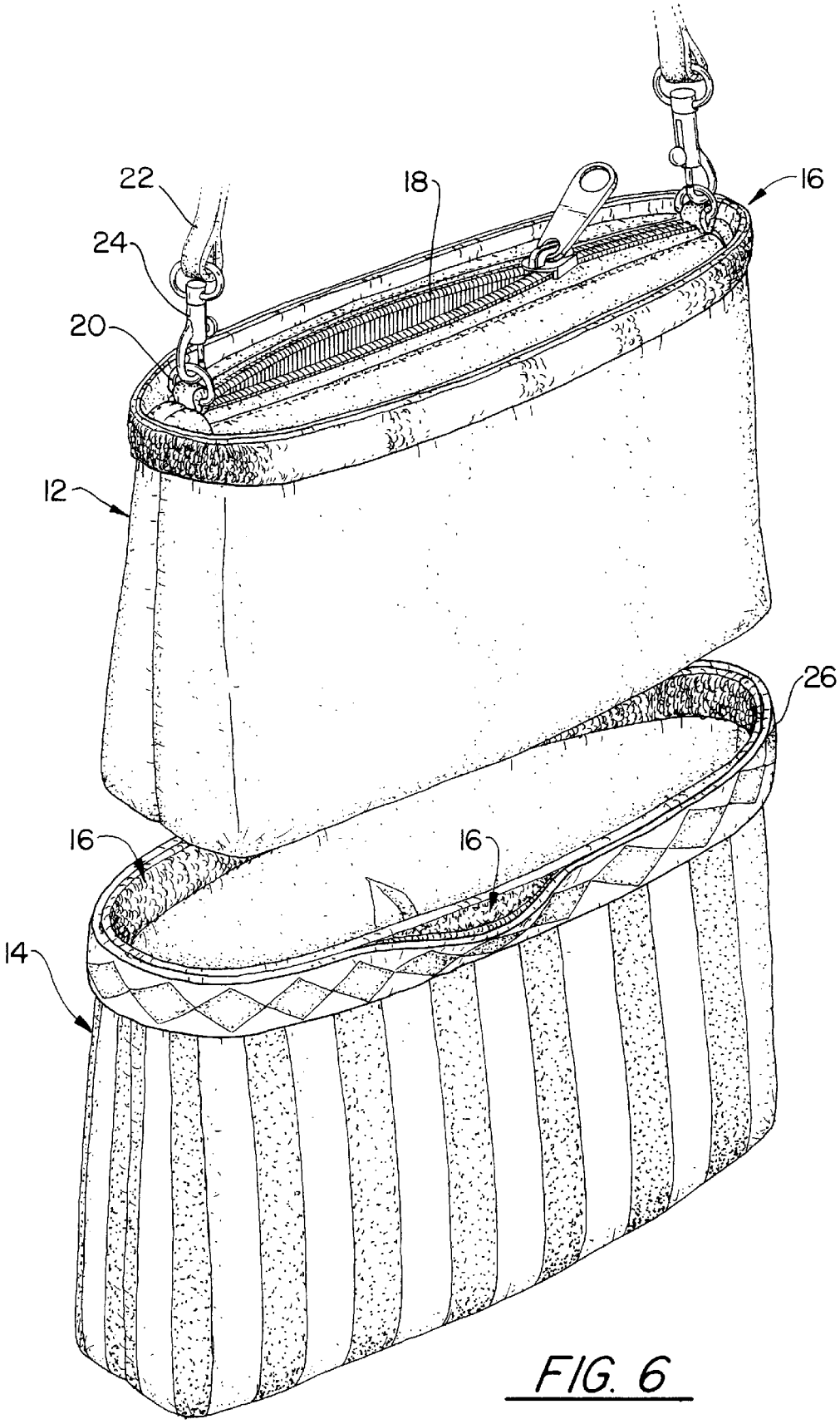
FIG. 6 shows the outer bag of the interchangeable carrying bag system in reversed form.

FIG. 6 shows an alternative embodiment of the interchangeable carrying system 10 in which the outer bag 14 can be a reversible bag. In this arrangement, the outer bag 14 can be reversed to receive the inner bag 12. Similar to the previous arrangements, the first fastening structure 16 can be attached to the inner bag 12. Here, however, the first fastening structure 16 can also be attached to the outer surface of the outer bag 14. Thus, when the outer bag 14 is reversed, the first fastening structure 16 attached to the original outer surface of the outer bag 14 (now the inner surface of the outer bag 14) can engage the first fastening structure 16 attached surface of the inner bag 12. In addition, the piece of decorative material 26 can be reversibly attached to the first fastening structure 16 attached to the outer bag 14 that is left exposed after the outer bag 14 receives the inner bag 12.

What is claimed is:

1. An interchangeable carrying bag system, comprising:

an inner bag having an inner surface and an outer surface;

an outer bag having an inner surface and an outer surface;

first fastening structure attached to said outer surface of said inner bag and said inner surface and said outer surface of said outer bag, wherein said outer surface of said inner bag is attachable to said inner surface of said outer bag by said first fastening structure; and at least one piece of decorative material attachable to said first fastening structure on said outer surface of said outer bag and on said outer surface of said inner bag when said inner bag is used independently of said outer bag, wherein substantially an entire length of said piece of decorative material is substantially adjacent to said outer surface of said inner bag.

2. The system according to claim 1, wherein said first fastening structure is a hook and loop type fastener circumferentially aligned along said outer surface of said inner bag and said inner surface of said outer bag.

3. The system according to claim 2, wherein said hook and loop type fastener is circumferentially aligned along a rim of said outer surface of said inner bag and a rim of said inner surface of said outer bag.

4. The system according to claim 1, wherein said piece of decorative material is a loop.

5. The system according to claim 1, wherein said piece of decorative material is a strip.

6. The system according to claim 1, further comprising a second fastening structure, wherein said second fastening structure is attached to said inner bag.

7. The system according to claim 6, wherein said second fastening structure is a zipper.

8. The system according to claim 1, wherein said inner bag contains at least one pouch permanently affixed to said inner bag.

9. The system according to claim 1, wherein said inner bag contains at least one pouch removably attached to said inner bag.

10. The system according to claim 1, wherein a first portion of said first fastening structure is attached to a first portion of said inner surface of said outer bag and a cooperating portion of said first fastening structure is attached to a second portion of said inner surface of said outer bag.

11. A method for interchanging carrying bags, comprising the steps of:

providing an inner bag having an inner surface and an outer surface;

providing an outer bag having an inner surface and an outer surface;

providing a first fastening structure attached to said outer surface of said inner bag and said outer surface and said inner surface of said outer bag;

attaching said outer surface of said inner bag to said inner surface of said outer bag; and attaching at least one piece of decorative material to said first fastening structure on said outer surface of said outer bag when said outer surface of said inner bag is attached to said inner surface of said outer bag and to said first fastening structure on said outer surface of said inner bag when said inner bag is used independently of said outer bag such that substantially an entire length of said piece of decorative material is substantially adjacent to said outer surface of said inner bag.

12. The method according to claim 11, wherein said first fastening structure is a hook and loop type fastener circumferentially aligned along said outer surface of said inner bag and said inner surface of said outer bag.

13. The method according to claim 12, wherein said hook and loop type fastener is circumferentially aligned along a rim of said outer surface of said inner bag and a rim of said inner surface of said outer bag.

14. A method for interchanging carrying bags, comprising the steps of:

providing an inner bag having an inner surface and an outer surface;

providing an outer bag having an inner surface and an outer surface; and providing fastening structure attached to said outer surface of said inner bag and said inner surface and said outer surface of said outer bag;

attaching said outer surface of said inner bag to said inner surface of said outer bag with said fastening structure; and reversing said outer bag by attaching said outer surface of said outer bag to said outer surface of said inner bag with said fastening structure.

15. The method according to claim 14, further comprising the steps of:

attaching at least one piece of decorative material to said outer surface of said outer bag when said outer surface of said inner bag is attached to said inner surface of said outer bag; and attaching said piece of decorative material to said inner surface of said outer bag when said outer bag is reversed and said outer surface of said outer bag is attached to said outer surface of said inner bag.

16. A method for interchanging carrying bags, comprising the steps of:

providing an inner bag having an inner surface and an outer surface;

providing an outer bag having an inner surface and an outer surface;

providing a first fastening structure attached to said outer surface of said inner bag and said inner surface of said outer bag;

reversibly attaching said outer surface of said inner bag to said inner surface of said outer bag;

reversibly attaching at least one piece of decorative material to said first fastening structure on said outer surface of said inner bag when said inner bag is used independently of said outer bag;

attaching said first fastening structure to said inner surface and said outer surface of said outer bag; and reversing said outer bag.

17. A method for interchanging carrying bags, comprising the steps of:

providing an inner bag having an inner surface and an outer surface;

providing an outer bag having an inner surface and an outer surface;

providing a first fastening structure attached to said outer surface of said inner bag and said inner surface of said outer bag;

reversibly attaching said outer surface of said inner bag to said inner surface of said outer bag;

reversibly attaching at least one piece of decorative material to said first fastening structure on said outer surface of said inner bag when said inner bag is used independently of said outer bag;

attaching said first fastening structure to said inner surface and said outer surface of said outer bag;

reversing said outer bag; and reversibly attaching said piece of decorative material to said outer surface of said outer bag.

18. The system according to claim 1, wherein said outer bag is reversible.

* * * * *